United States Patent [19]

den Otter

[11] Patent Number: 4,970,778

[45] Date of Patent: Nov. 20, 1990

[54] APPARATUS FOR CONNECTING ELECTRICAL CONNECTORS TO CABLE

[75] Inventor: Johannes M. J. den Otter, Rosmalen, Netherlands

[73] Assignee: AMP Incorporated, Harrisburg, Pa.

[21] Appl. No.: 484,451

[22] Filed: Feb. 20, 1990

Related U.S. Application Data

[63] Continuation of Ser. No. 374,687, Jun. 29, 1989, abandoned.

[51] Int. Cl.[5] ..... H01R 43/04

[52] U.S. Cl. ..... 29/749; 29/759; 29/760

[58] Field of Search ..... 29/749, 747, 751, 753, 29/759, 760

[56] References Cited

U.S. PATENT DOCUMENTS

| | | | |
|---|---|---|---|
| 4,561,178 | 12/1985 | van de Kerkhof | 29/749 |
| 4,575,935 | 3/1986 | Shields | 29/749 X |
| 4,584,757 | 4/1986 | Adlon et al. | 29/564.6 |
| 4,675,996 | 6/1987 | Anderson | 29/861 |
| 4,856,187 | 8/1989 | Blaha | 29/867 |

*Primary Examiner*—Carl E. Hall

*Attorney, Agent, or Firm*—Bruce J. Wolstoncroft; Eric J. Groen

[57] ABSTRACT

The apparatus comprises a rotary jaw assembly which is movable along a first axis between two rows of connectors and along a second axis to grasp a selected connector and then to retract, after which the jaw assembly is rotatable about a third axis to change the endwise orientation of the connector grasped by the assembly. This connector is then passed by a push rod to a cover separating station at which the cover is separated from the body of the connector. Further push rods transfer the connector body and the cover to a turntable to rotate them about a vertical axis, and yet further push rods transfers the connector and the cover to an application station at which they are applied to a cable. Each connector can be thus applied to cable in four different orientations connector and the cover to an application station at which they are applied to a cable. Each connector can be thus applied to cable in four different orientations.

10 Claims, 14 Drawing Sheets

APPARATUS FOR CONNECTING ELECTRICAL CONNECTORS TO CABLE

This application is a continuation of application Ser. No. 07/374,687 filed June 29, 1989, now abandoned.

This invention relates to apparatus for connecting to the conductors of a flat, multiconductor cable, electrical connectors having terminals provided with conductor receiving portions, and especially concerns such apparatus for producing electrical harnesses each comprising a plurality of such connectors.

There is described in EP-Al-0196740, apparatus for connecting to the conductors of a flat, multiconductor cable, electrical connectors having electrical terminals provided with cable conductor receiving portions, the apparatus comprising a press which is actuable to apply the connectors to the cable by inserting the cable conductors into said conductor receiving portions, means for feeding the cable intermittently through the press, and connector orienting means for supplying the connectors to the press in a plurality of different orientations and including a first connector receiving member which is rotatable to determine a first orientation of each connector.

Although this known apparatus is capable of orienting connectors on the cable so that some project from one side of the cable and some from the other, and is also capable of applying the connectors to the cable in different endwise orientations, the known apparatus, which comprises a robot adapted to perform some of the connector orienting operations and a multiplicity of associated stations around the robot, is, although it has proved to be most successful in use, of complicated construction and is, therefore expensive to produce.

The present invention is intended to provide apparatus as defined in the second paragraph of this specification, but which is simpler and more compact than the known apparatus and is more economical to manufacture.

According to the invention, the apparatus is characterized by first means for transferring each connector from said first connector receiving member when the connector has been oriented thereby, to a second connector receiving member which is rotatable to determine a second orientation of the connector; and by second means for transferring the connector from the second connector receiving member when the connector has been oriented thereby, to the press.

The first connector receiving member may be in the form of a pair of rotatable jaws connected to a frame of the apparatus and being rotatable by a rotary air cylinder on the frame, the second connector receiving member being in the form of a simple turn table also mounted to the frame and having drive means on the frame. Both of the transferring means may be in the form of push rods.

The jaws may be translatable transversely of a plurality of rows of electrical connectors fed in parallel relationship towards the jaws, to select a desired kind of connector for application to the cable.

Where the connectors are of the kind which comprise a connector body arranged to mate with a cover having conductor stuffing means for forcing the conductors into the wire receiving portions of the terminals, the connector bodies are supplied to the first connector receiving member with the covers partially mated therewith, a cover separating station being provided between the two connector receiving members for separating the covers from the connector bodies. In this case, the turntable is provided with a pair of parallel recesses, each for receiving either a connector body or a cover according to the angular position of the turntable the press comprising a pair of pusher plates, one disposed on either side of the cable and each arranged to receive either a connector body or a connector cover according to said angular position of the turntable. Cable severing means are provided for severing the cable when a required number of connectors have been applied thereto.

For a better understanding of the invention and to show how it may be carried into effect, reference will now be made by way of example to the accompanying drawings in which.

Figure 1:
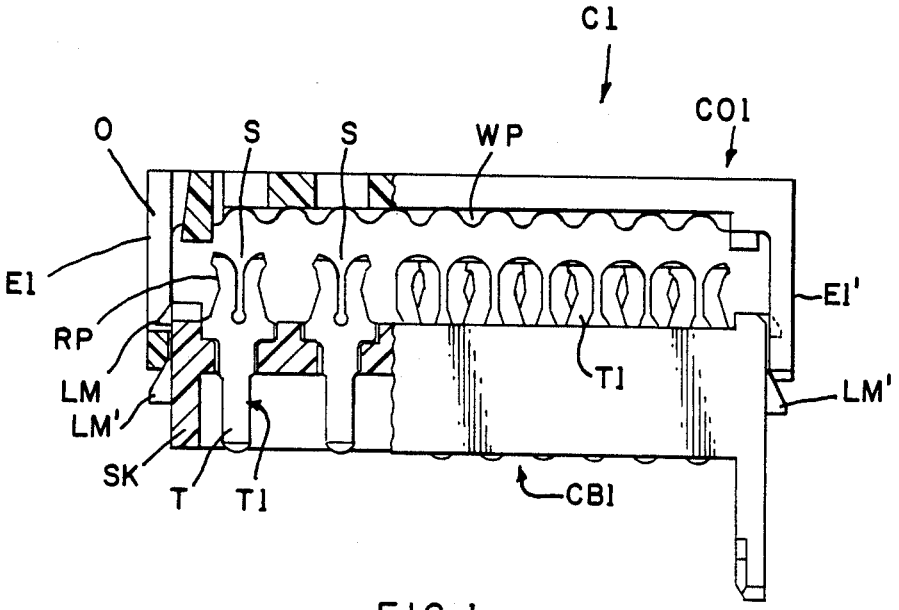
FIG. 1 is a side view, shown partly in section, of a first electrical connector.
Figure 2:
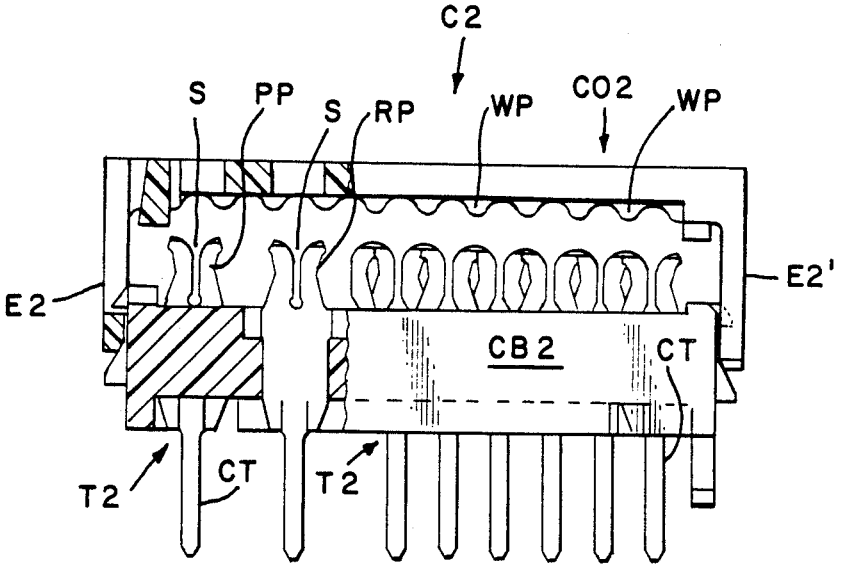
FIG. 2 is a similar view to that of FIG. 1, but showing a second and different electrical connector.

As shown in FIG. 1, an elongate electrical connector C1 comprises a connector body CB1 and a connector cover CO1. In the body CB1 are two rows of electrical terminals T1 each having a conductor receiving portion RP provided with a conductor receiving slot S. Each terminal T1 has a tab T extending into a skirt SK of the body CB1 for mating with a female electrical terminal (not shown) of a mating connector (not shown) inserted into the skirt SK. The cover CO1 has wire stuffer projections WP each for forcing the conductor of a multiconductor flat, flexible cable FFC (FIG. 2), into a respective slot S, as the cover CO1 is driven down, from the position in which it is shown, onto the connector body CB1. At each end of the body CB1, are two vertically spaced latching spurs LM and LM'. Each upper (as seen in FIG. 1) and smaller, spur LM engages in an opening O in a side arm of the cover CO1 to retain it releasably attached to the body CB1. When the cover CO1 is driven down to cause the projections WP to force the conductors into the slots S, the lower (as seen in FIG. 1) and larger, latch arm LM' engages in the opening O, fixedly to secure the cover CO1 to the body CB1. The connector C1 has opposite ends E1 and E1'. FIG. 2 shows a connector C2 having a connector body CB2 and a cover CO2 which is identical to the cover CO1. The body CB2 differs from the body CB1 in that its terminals T2 have contact tails CT projecting below the body CB2 for reception in holes in a circuit board (not shown), to be soldered to conductors thereon. The connector C2 has ends E2 and E2'.

Figure 3:
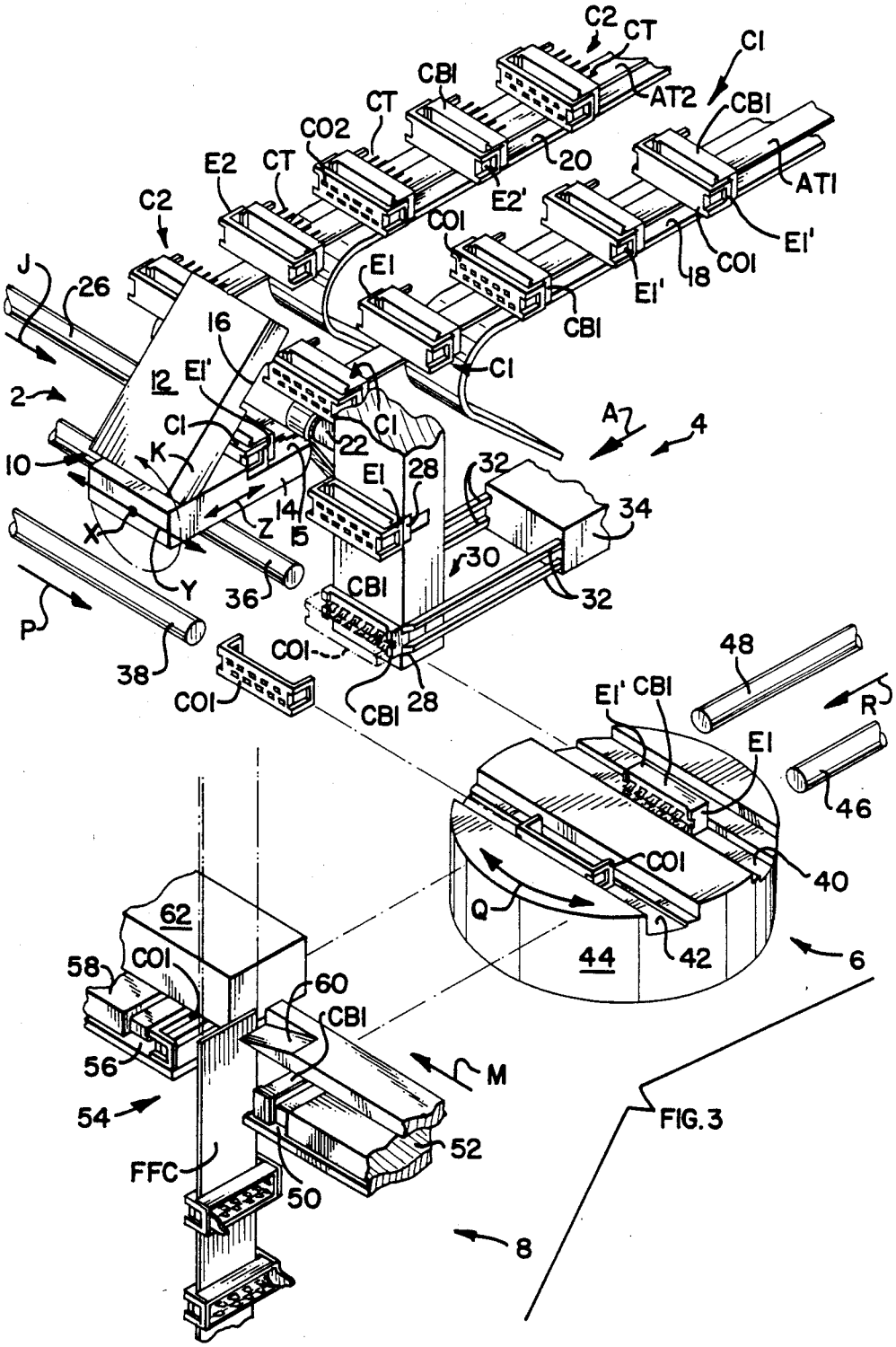
FIG. 3 is a schematic, isometric, view of harness making apparatus for selectively applying to a flat multiconductor cable, electrical conductors according to FIGS. 1 and 2.

The apparatus and its operation will now be described in outline, with reference to FIG. 3. The apparatus comprises a first connector orientating station 2, a connector cover separating station 4, a second connector orienting station 6, and a connector application station 8.

At the station 2, is a first connector receiving member in the form of a connector retaining jaw assembly 10 which is rotatable about a horizontal axis X between two angular positions spaced from each other by 180 degrees as determined by a harness making program of a control microprocessor (not shown). The jaw assembly 10 is translatable, according to the program, along a first horizontal axis Y and a second horizontal axis Z extending at right angles to the axis Y and parallel to the axis X. The jaw assembly 10 comprises a jaw 12 which can be swung towards and away from a fixed jaw 14 about a horizontal axis K, parallel to the axis Y, between the open position in which the jaws 12 and 14 are shown in FIG. 3, and a closed position in which a connector C1 or C2 to be received by the assembly 10 is enclosed between a flat surface 15 of the jaw 14 and the walls of a recess 16 in the jaw 12.

A row of first connectors C1 mounted on a length of adhesive tape AT1 and a row of second connectors C2, parallel to, but spaced from, the row of connectors C1, and mounted on a length of adhesive tape AT2 are arranged to be intermittently fed along guide tracks 18 and 20, respectively, from respective storage reels (not shown) by means of tape pulling rolls (not shown) beneath the jaw assembly 10, towards of the assembly 10, in accordance with the program.

Where the jaw assembly 10 is to pick up a connector C1, in the course of the program, the assembly 10 is translated along the axis Y with the jaws 12 and 14 in an open position to place them opposite to the leading connector C1 on the tape AT1 and the assembly 10 is advanced to its forward end position along the axis Y. The pulling rolls of the tape AT1 are then actuated to draw the row of connectors C1 towards the assembly 10, the tape AT1 passing over a nose 22 so that the leading connector C1 is pulled from the tape AT1 and is thereby transferred to the surface 15 of the jaw 14 so as to lie between the jaws 14 and 16. The jaw 12 is then closed about the axis K to confine the connector C1 on the surface 15 and the assembly 10 is rotated about the axis X, if that is required by the program, to reverse the endwise orientation of connector C1 retained in assembly 10, so that the end E1 of the connector faces rightwardly (as seen in FIG. 3). The assembly 10 is now retracted to its rear end position along the axis Y and a push rod 26 is advanced in the direction of the arrow J in FIG. 3 slidably to drive the connector C1 from between the jaws 12 and 14, and to transfer the connector to the station 4 so that its body CB1 is slidably inserted into a nest 28 provided in a vertically movable connector body holder 30 of the station 4, which is arranged to be driven in vertical reciprocating motion. The holder 30 is then lowered so that the nest 28 is positioned in alignment with ejector fingers 32 at the station 4, which project from a cover separating tool 34, said fingers 32, being arranged in two pairs of superposed fingers 32 which straddle the holder 30. The tool 34 is now advanced in the direction of the arrow A to drive the cover CO1 of the connector C1 in the nest 28 away from its body CB1, as shown in full lines into a cover receiving nest (not shown). Push rods 36 and 38 are now advanced in the direction of the arrow P in FIG. 3 to transfer the body CB1 in the nest 28, and the now separated cover CO1, into respective grooves 40 and 42 in a second connector receiving member in the form of turntable 44 which is mounted at the station 6, for rotation about a vertical axis through 90 degrees in either sense as indicated by the arrow Q. Where the body CB1 in the groove 40 is to be applied to the right hand (as seen in FIG. 3) side of the tape FFC and the cover CO1 to the opposite side thereof, the turntable 44 is rotated to bring the end E1' of the body CB1 in the groove 40 into alignment with a first push rod 46 and the corresponding end of the cover CO1 in the groove 42 into alignment with a second push rod 48. The push rods 46 and 48 are then advanced in the direction of the arrow R, that is to say at right angles to the direction of movement of the rods 26, 36 and 38, to transfer the body CB1 into a nest 50 in a first applicator push plate 52 of a press 54 at the station 8, and the cover CO1 into a nest 56 in a second applicator push plate 58 of the press 54. The cable FFC which is intermittently advanced downwardly between the plates 52 and 58 by steps of predetermined length, and the plates 52 and 58 are advanced to drive the cover CO1 towards the body CB1, whereby the stuffer projections WP force respective conductors of the cable FFC into respective slots S of the terminals T1 of the body CB1 and the spurs LM' engage in the openings O. When the number of connectors CB1 and CB2 prescribed according to the harness-making program, has been applied to the cable FFC a cable-severing blade 60 is advanced in the direction of the arrow M to sever the cable FFC adjacent to the connector last applied thereto, in cooperation with a cable severing anvil 62.

Where a connector C2 is to be applied to the cable FFC, the assembly 10 at the station 2 is translated to a position in alignment with the leading connector C2 of the row of connectors C2 to receive it in the manner described above with reference to a connector C1. Where the end E1' or E2' of any leading connector C1 or C2 is to face rightwardly (as seen in FIG. 3), the assembly 10 is not rotated about the axis X when it has received the connector. Likewise, if a cover CO1 or CO2 is to be applied to the right hand (as seen in FIG. 3) side of the cable FFC, and the corresponding connector body CB1 or CB2, as the case may be, is to be applied to the left hand side of the cable FFC, the turntable 44 is rotated to bring the connector body in alignment with the push rod 48 and the connector cover into alignment with the push rod 46.

As will be apparent from the above description, the apparatus can selectively apply connectors C1 and C2 to the cable FFC at any desired position therealong, each in a selected one of four different orientations with respect to the cable FFC, that is to say with the cover on one side or the other, and with either end of the connector facing in a given direction, in accordance with the particular harness making program with which the microprocessor has been provided.

The push plate of the press 54, which carries the cover is always applied to the cable before the other push plate in order to avoid lateral displacement of the cable by the connector body.

The apparatus and its operation will now be described in greater detail with reference to FIGS. 4 to 16.

Figure 4:
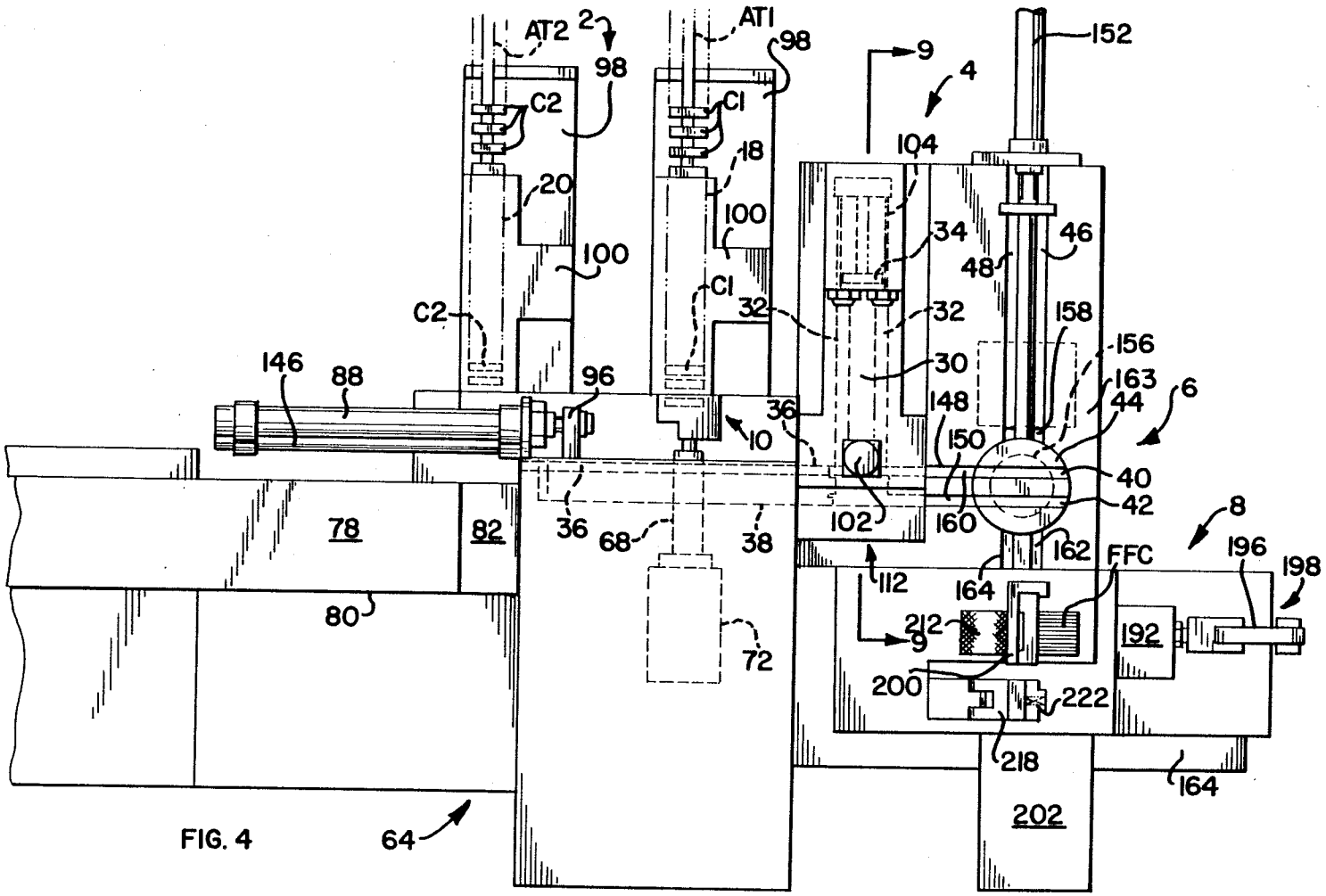
FIG. 4 is a top plan view of the apparatus.

As shown in FIG. 4, the apparatus comprises a single frame generally referenced 64 to which the stations 2, 4, 6 and 8 are mounted.

Figure 5:
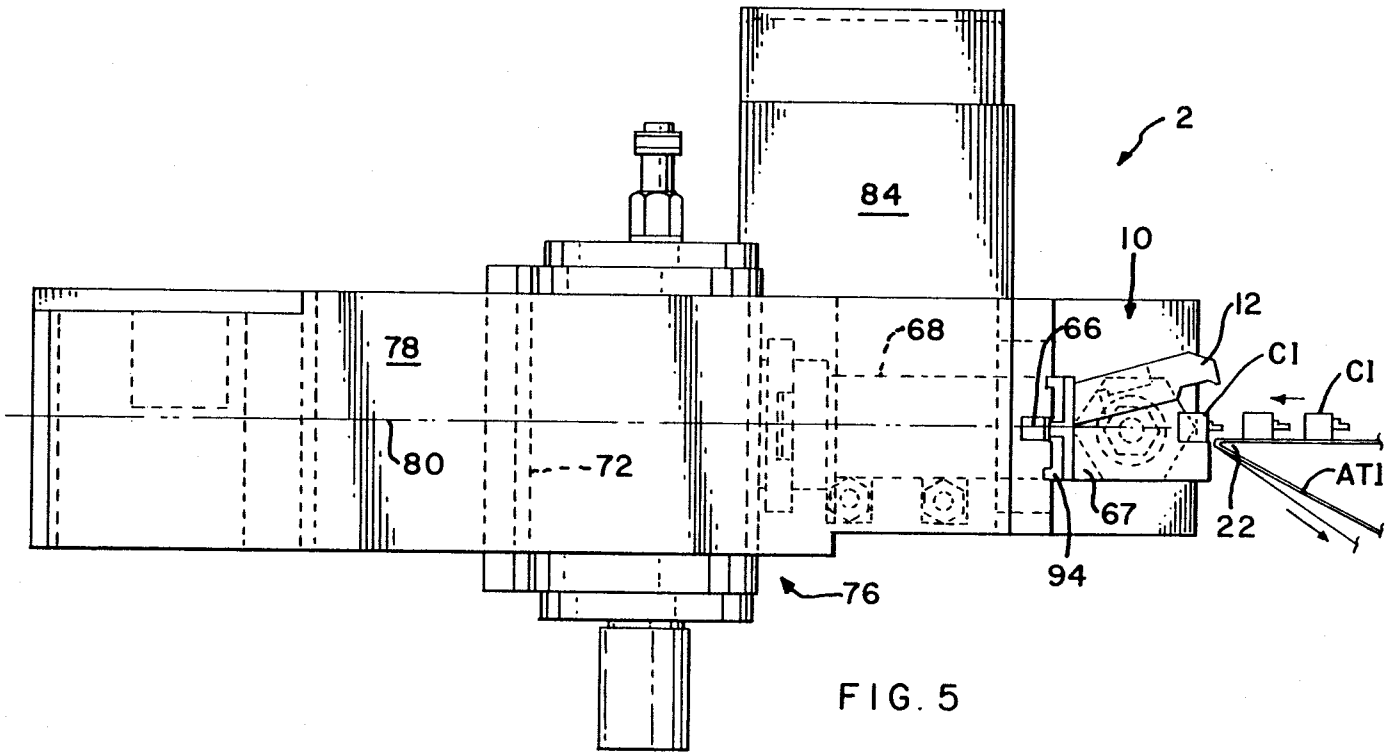
FIG. 5 is a side view of a first connector orienting station of the apparatus, taken in the direction of the arrow 5 in FIG. 7, and showing parts of the station in a first operating position.
Figure 6:
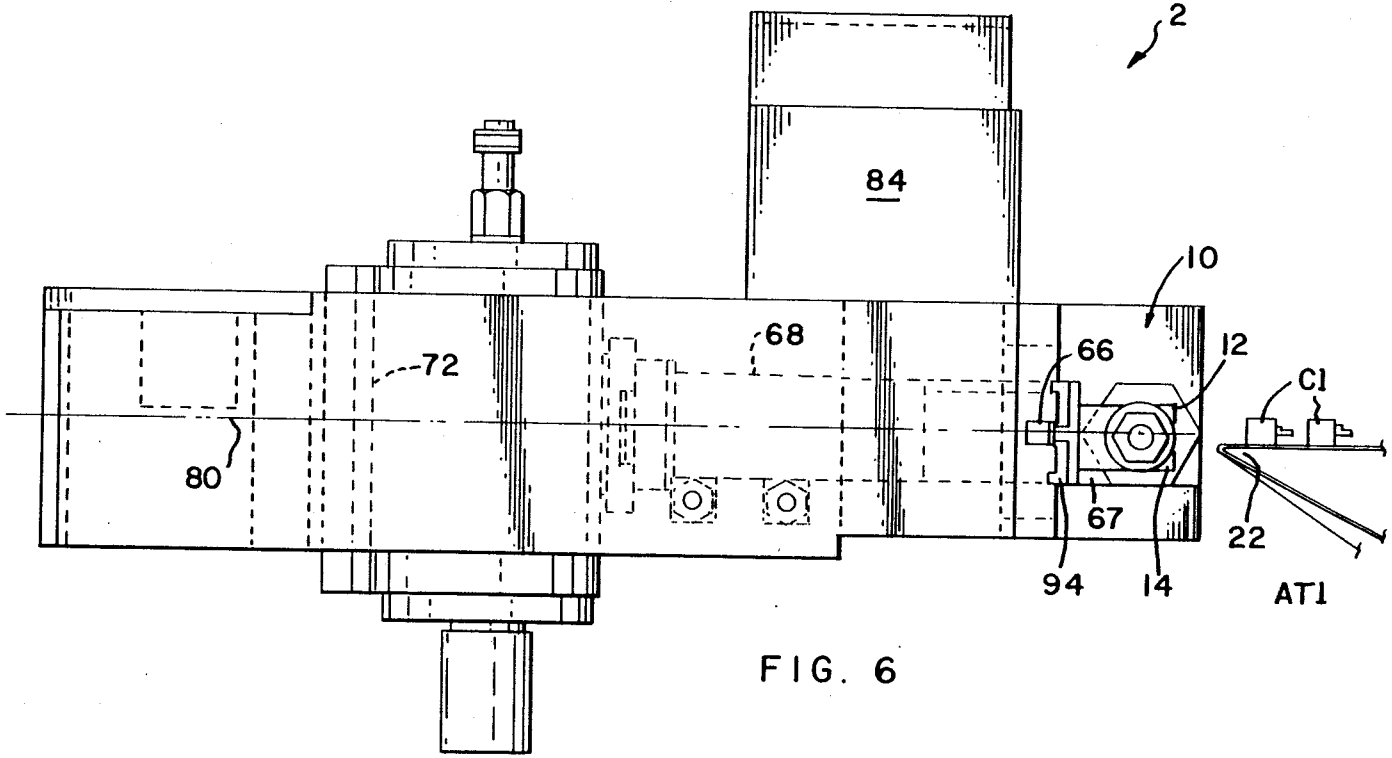
FIG. 6 is a similar view to that of FIG. 5 but showing said parts of the orienting station in a second operating position.
Figure 7:
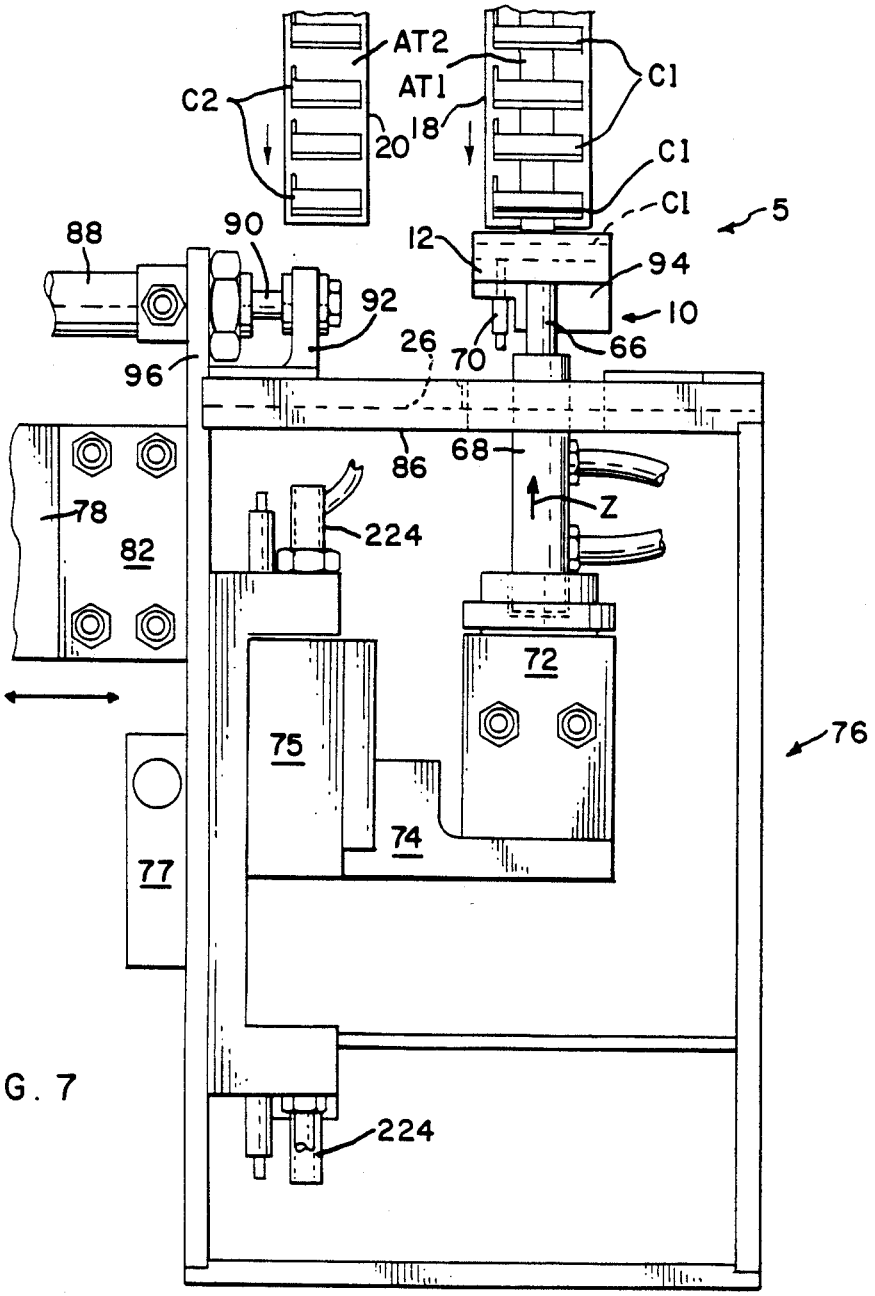
FIG. 7 is a top plan view of the first connector orienting station showing said parts in said first position.
Figure 8:
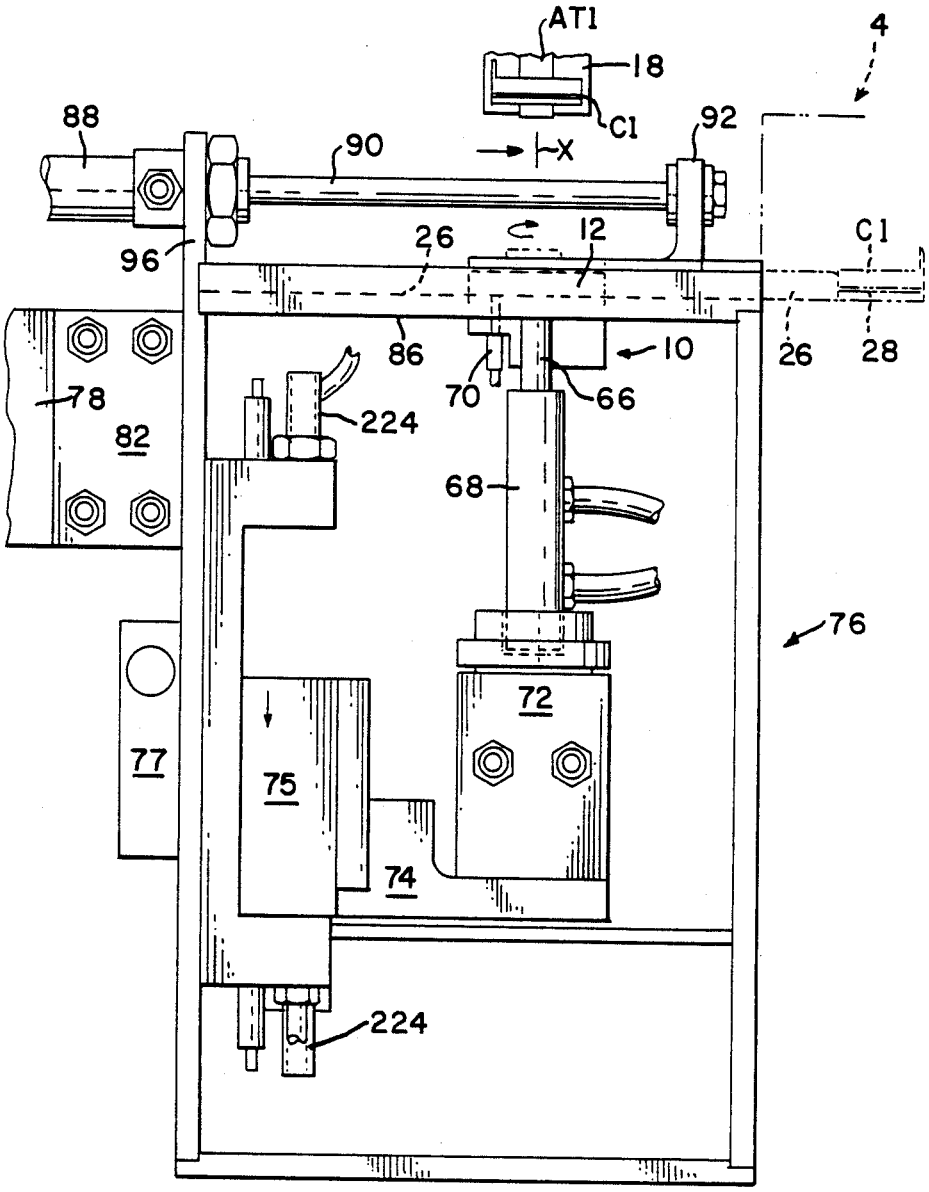
FIG. 8 is a similar view to that of FIG. 7, but showing said parts in said second position.

As shown in FIGS. 5–8, a main block 67 of the assembly 10, of which block the jaw 14 is a part, is connected to the piston rod 66 of a pneumatic piston and cylinder unit 68 for operating the jaw 12. An optical sensor 70 is provided in the block 67 for sensing the presence of a connector C1 or C2 in the assembly 10. The unit 68 is connected to the spindle of a motor 72 in the form of a rotary air cylinder for rotating the assembly 10. The motor 72 is fixed to a bracket 74 which is in turn secured, by way of a slide 75, to a horizontally shiftable subframe 76. The slide 75 is slidable in the direction of the Z-axis relative to the subframe 76. The subframe 76 is connected to a slide 78 mounted for horizontal sliding movement relative to the frame 64 on a slideway 80 (FIGS. 4 and 5). The subframe 76 is fixed to the slide 78 by means of a fastening plate 82 on each side of the slide 78, and only one of which is shown. The assembly 10 is driven back and forth along the Z-axis by means of drive means (not shown). An amplifier 77 for sensor 70 is provided on the subframe 76. The slide 78 is driven in horizontal reciprocating motion, to move the assembly 10 along the axis Y to select a connector C1 or C2 according to the program, by means of a rack and pinion drive system (not shown) in a housing 84 on the frame 64. The subframe 76 comprises a top plate 86 along a track, in which the push rod 26 is slidable by means of a piston and cylinder drive unit 88 fixed to a slide plate 96 of the subframe 76 and having a piston rod 90 secured to a bracket 92 on the push rod 26, to drive it through a working stroke to transfer a connector C1 or C2 from the assembly 10 to the station 4. The piston rod 66 is connected to the block 67 by way of a bracket 94, so that the drive unit 68 is vertically offset from the path of movement of the push rod 26. As shown in FIG. 4, the tracks 18 and 20 are mounted to plates 98 projecting laterally from the frame 64 and to which are secured guard plates 100 for the rows of connectors C1 and C2 on the tracks 18 and 20. FIGS. 5 and 7 show the assembly 10 in its advanced position to receive a connector C1 and FIGS. 6 and 8 show the assembly 10 in its retracted position along the axis Z and as it is being rotated about the axis X.

Figure 9:
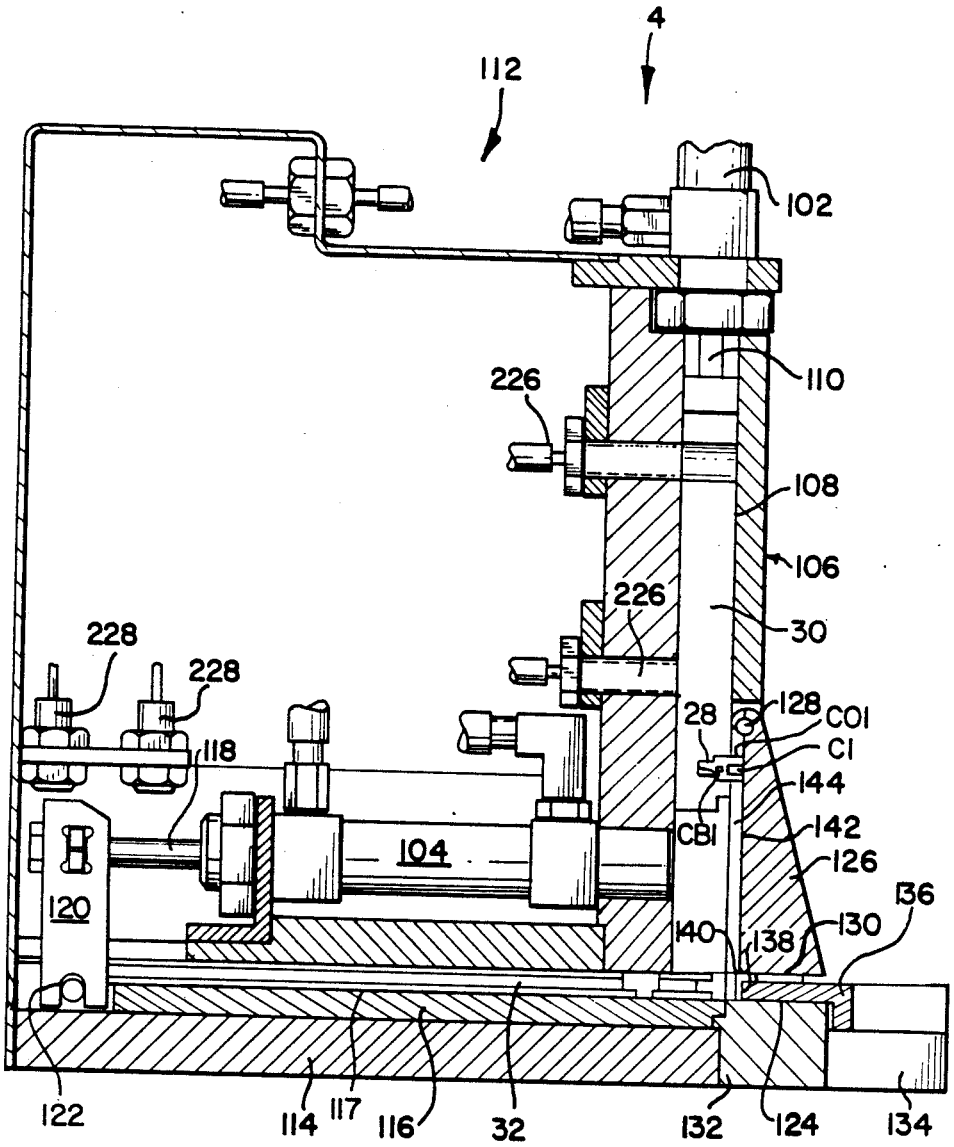
FIG. 9 is a view taken on the lines 9—9 of FIG. 4 illustrating a cover separating station of the apparatus, and showing parts thereof in a first operating position.
Figure 10:
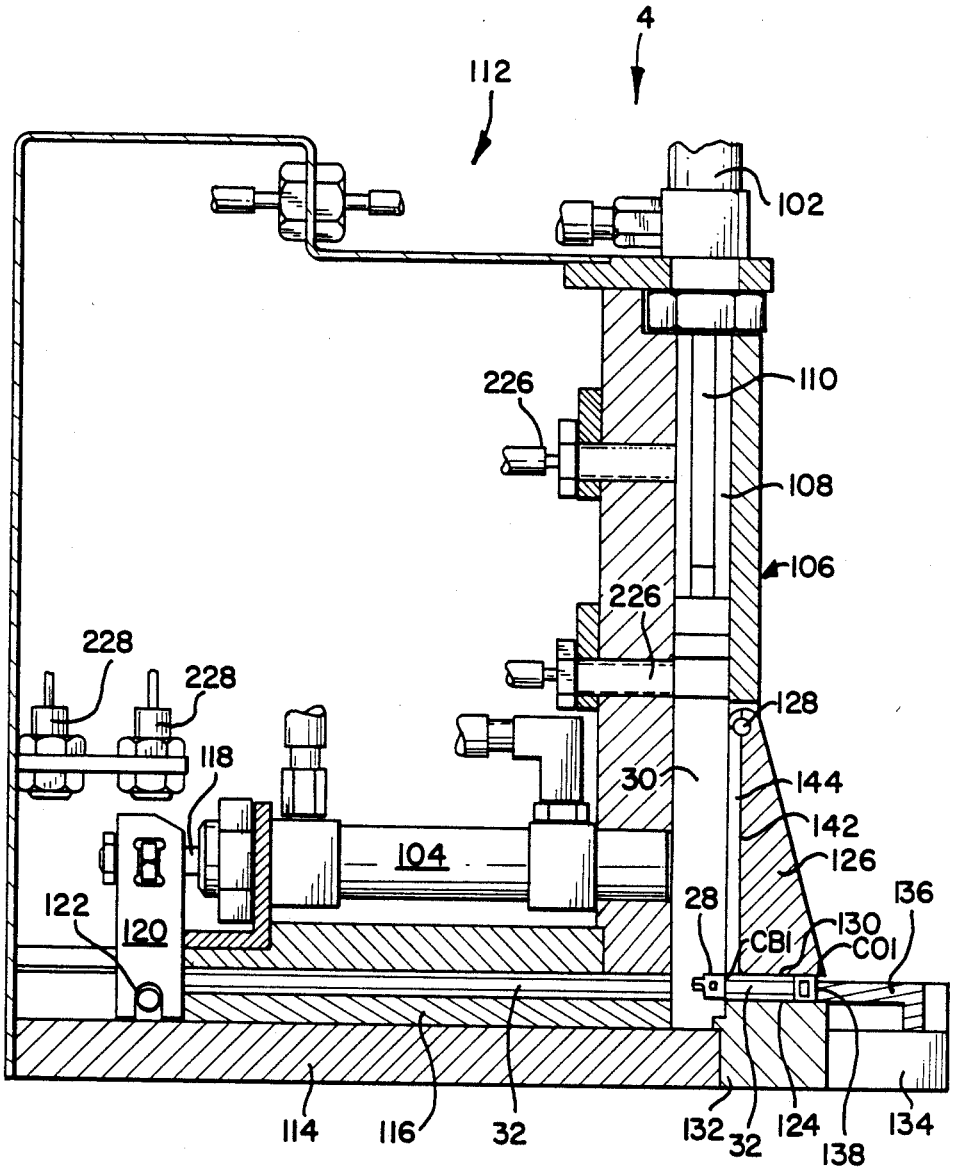
FIG. 10 is a similar view to that of FIG. 9 but showing parts of the cover separating station in a second operating position.

As shown in FIGS. 9 and 10, the connector holder 30 is driven through a downward stroke to lower the nest 28 and through an upward return stroke to raise it, by means of a vertical piston and cylinder unit 102, also shown in FIG. 4, the cover separating tool 34 and thus the ejector fingers 32 being driven by a horizontal piston and cylinder unit 104 which is shown in FIG. 4. The unit 102 is mounted to the top of an elongate slideway block 106 defining a vertical slideway 108 for the connector holder 30 which is fixedly attached to the piston rod 110 of the unit 102. The block 106 is mounted in a subframe 112 to the bottom plate 114 of which is secured a horizontal slideway block 116 defining slideways 117 for the fingers 32. One end of the unit 104 is mounted to the block 116, the other end of the unit 104 being mounted in the block 106. The piston rod 118 of the unit 104 is fixed to a bracket 120 which is attached to the ejector fingers 32 by means of pin and socket connections 122, only one of which is shown. The cover-receiving nest mentioned above with reference to FIG. 3, and which is not shown therein, is referenced 124 in FIGS. 9 and 10. It comprises a triangular cross section top plate 126, the upper end of which is pivotally attached to the block 106 by means of a pivot pin 128, the lower face 130 of the plate 130, and the upper face of a bottom block 132 fixed to the plate 114, defining upper and lower walls, respectively, of the nest 124. A slide 134, which is slidable horizontally in the block 132, has an arm 136 which is slidable in the nest 124 and is urged by springs (not shown) inwardly of the nest 124 to assume a normal position in which the free end face 138 of the arm 136, which face has therein a cover-receiving recess 140 is substantially coincident with the inner vertical wall 142 of the plate 126, which face 142 is formed with a vertical cover-receiving channel 144 communicating with the slideway 108 and extending parallel thereto. FIG. 9 shows the connector holder 30 in its raised position, with a connector C1 in the nest 28 with its cover CO1 engaged in the recess 144 and abutting the surface 142, the piston rod 118 being in an advanced position so that the fingers 32 are retracted. FIG. 10 shows the connector holder 30 in its lowered position and after the piston rod 118 has been retracted to cause the ejector fingers 32 to advance and thereby to separate the cover CO1 from the connector body CB1, and to drive the cover CO1 into the recess 140 of the arm 136, driving the arm 136, and thus the slide 134 rightwardly (as seen in FIG. 10) so that the cover CO1 is received in the nest 124 and is releasably held in position between the end face 138 and the ejector fingers 32. Should a cover CO1 or CO2 jam in the nest 124, the plate 126 can be raised about the pivot pin 128 to allow the jammed cover to be removed from the nest 124. The push rods 36 and 38 are driven by a piston and cylinder unit 146 which, as shown in FIG. 4, extends parallel to, and projects slightly to one side of, the unit 88. A guide track 148 communicates with the nest 28, in the lowered, FIG. 10 position of the connector holder 30, a guide track 150 communicating with the space between the surface 138 of the arm 136 and the leading ends of the ejector fingers 32, when the ejector fingers 32 are in their FIG. 10 position. When the piston rod of the unit 146, which is connected to the push rods 36 and 38, is advanced, these push the body and the cover from their FIG. 10 positions in the station 4, along the tracks 148 and 150 respectively, and into the grooves 40 and 42 of the turntable 44.

Figure 11:
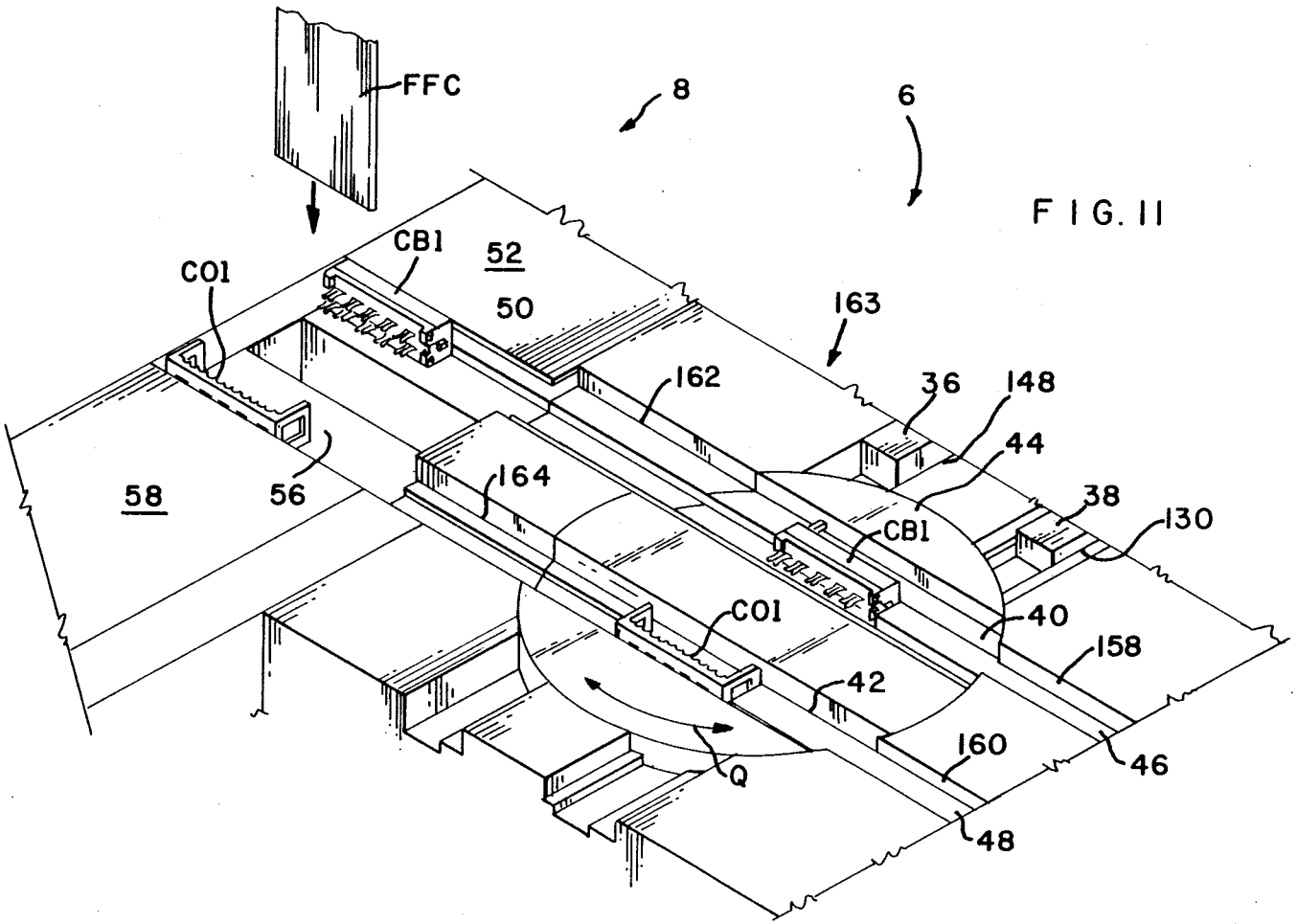
FIG. 11 is an isometric view illustrating a second connector orienting station of the apparatus and the transfer of a connector and its cover therefrom, to a connector application station of the apparatus.

The push rods 46 and 48 are driven by a horizontal piston and cylinder unit 152, to the piston rod 154 of which the rods 46 and 48 are connected, as shown in FIG. 4. The turntable 44 is driven by a stepping motor 156 therebelow as indicated in broken lines in FIG. 4. The push rods 46 and 48, run in guide channels 158 and 160, respectively, formed in a top plate 163 of the station 6, in an opening in which plate 136, the turntable 44 is rotatable, as best seen in FIG. 11, by means of its motor 156, which lies below the plate 163. When the turntable 44 has been rotated by its motor 156 to align the grooves 40 and 42 with the push rods 46 and 48, and thus with the guide channels 158 and 160, the grooves 40 and 42 are also aligned with respective connector body or connector cover guideways 162 and 164 formed in the plate 162 in alignment with the channels 158 and 160, each guideway 162 and 164 being cross-sectionally configured to receive either a connector body or its cover. The guideways 162 and 164 communicate with, and are aligned with, the nests 50 and 56, respectively, of the plates 52 and 58, respectively, at the station 8. When the piston rod 154 of the unit 152 is advanced, the push rods 46 and 48 drive the connector body and the connector cover in the grooves 40 and 42, along the guideways 162 and 164 and position them in their respective nests 50 and 56.

Figure 14:
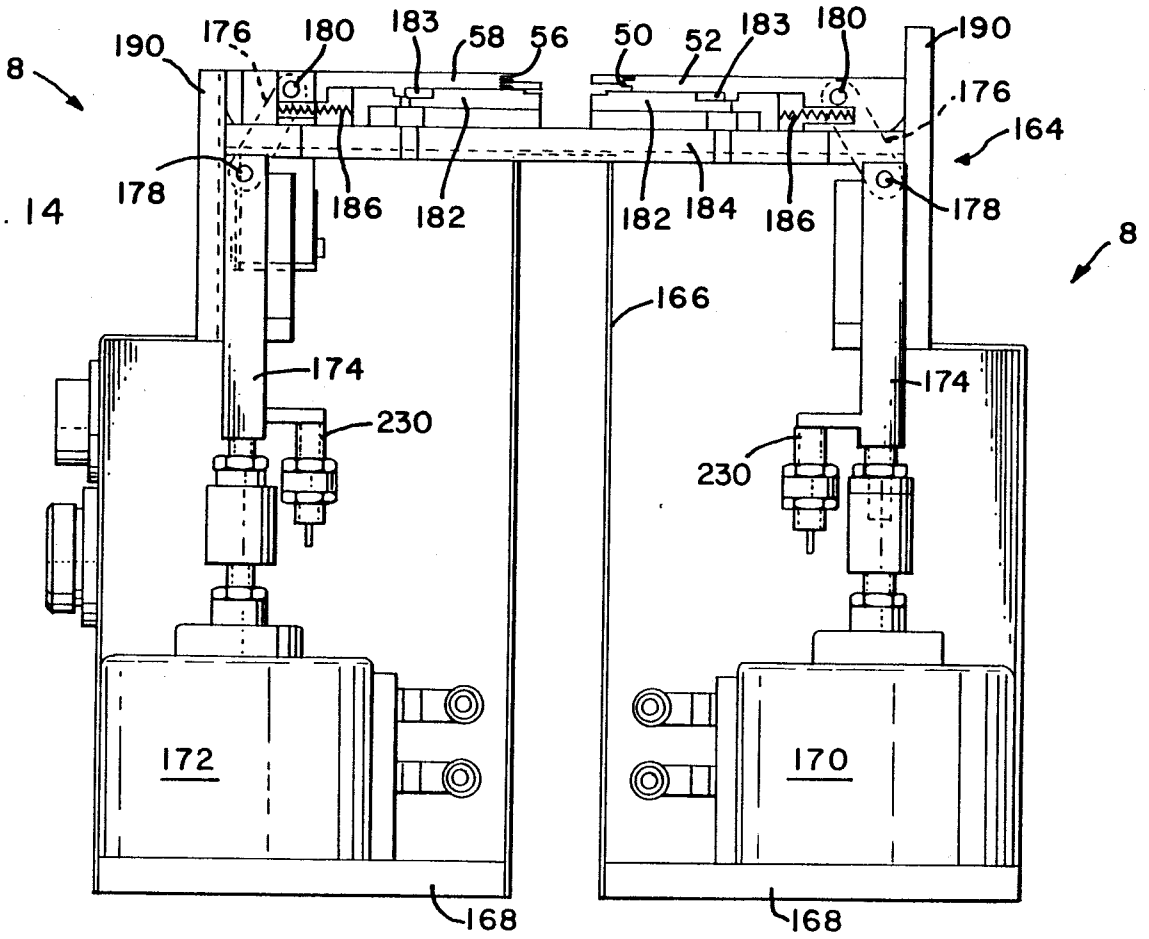
FIG. 14 is a side view of the termination station showing parts thereof in a first operating position.
Figure 15:
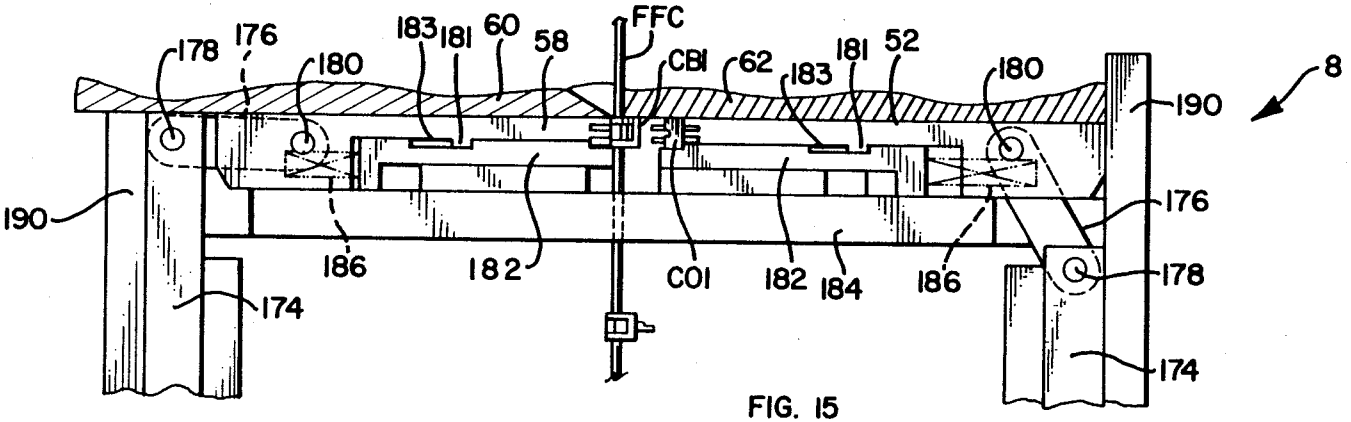
FIG. 15 is a fragmentary side view, shown partly in section, illustrating details of FIG. 14 but showing said parts in a second operating position.
Figure 16:
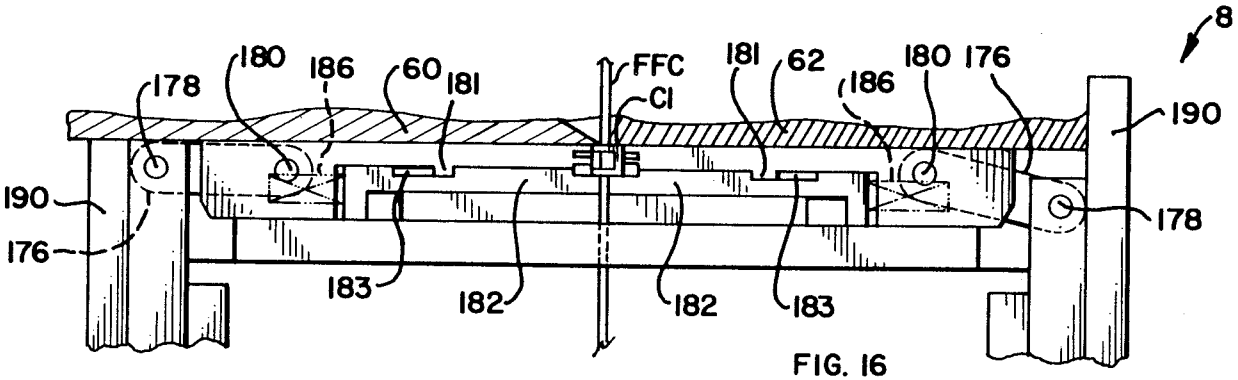
FIG. 16 is a similar view to that of FIG. 15 but showing said parts in a third operating position.

As shown in FIG. 14, the connector application station 8 comprises a subframe 164 having a central harness receiving vertical channel 166 to a base plate 168 of which are mounted on either side of the channel 166 a drive piston and cylinder unit 170 for the push plate 52 and a drive piston and cylinder unit 172 for the push plate 58. The piston rod 174 of each of these units is connected to one end of a link 176 by means of a pivot pin 178, the other end of the link 176 being pivotally connected by means of a pivot pin 180, to the respective push plate 52 or 58, near its end remote from the respective nest 50 or 56. The push plates 50 and 58 which have depending lugs 181 running in grooves 183 in push plate support brackets 182, on a top plate 184 of the subframe 164, are normally urged in a direction away from one another by springs 186 acting between the toggle links 176 and the brackets 182. In order to apply a connector body and a connector cover in the respective nests 50 and 56, to the cable FFC, the units 170 and 172 are actuated sequentially to advance their piston rods 174 to rotate the links 176 so as to drive the push plates 52 and 58 towards one another. As shown in FIGS. 15 and 16, the drive unit for the push plate carrying the connector cover is first actuated so that the cable FFC is enclosed by the cover, the drive unit for the push plate carrying the connector body being actuated subsequently, to drive it into the cover.

Figure 12:
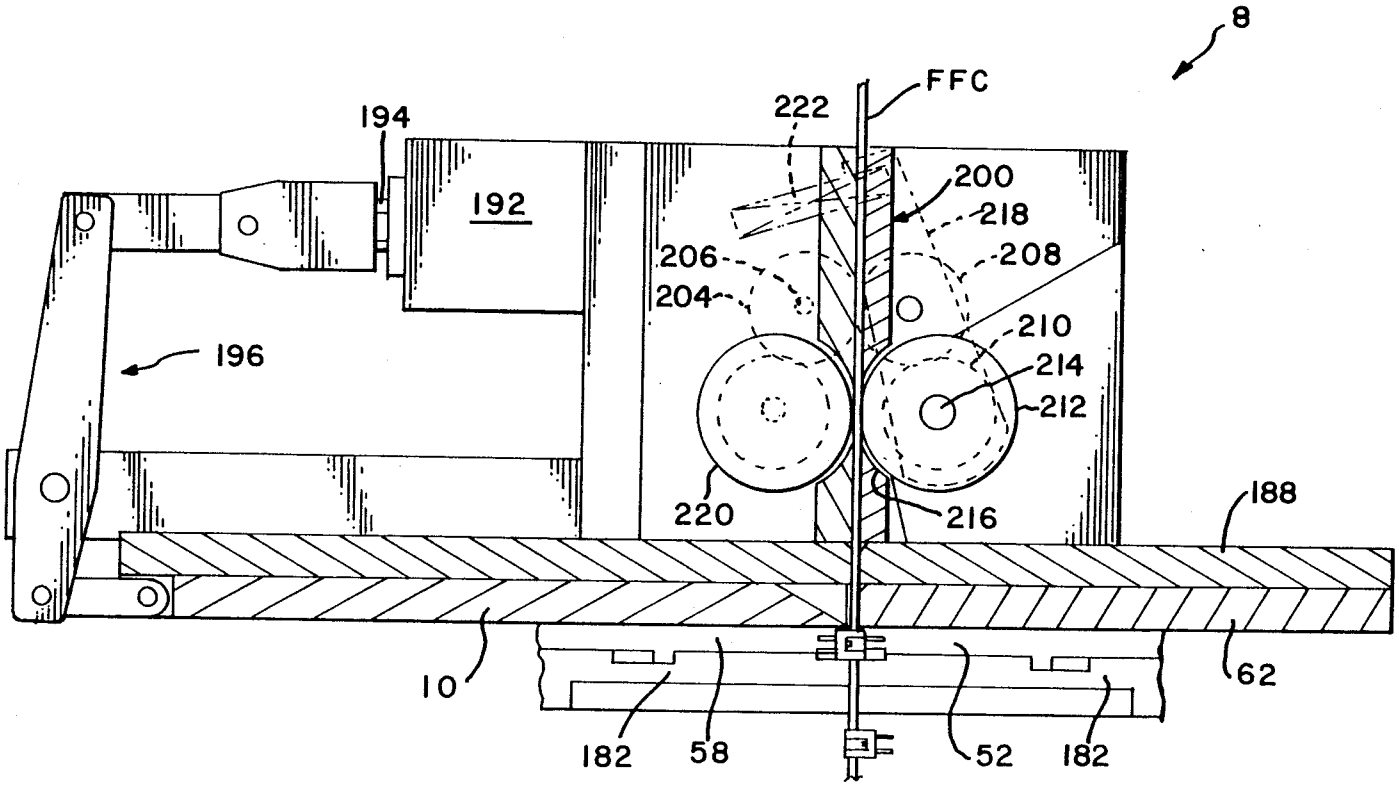
FIG. 12 is a side view, shown partly in section, and with parts omitted, of the termination station.
Figure 13:
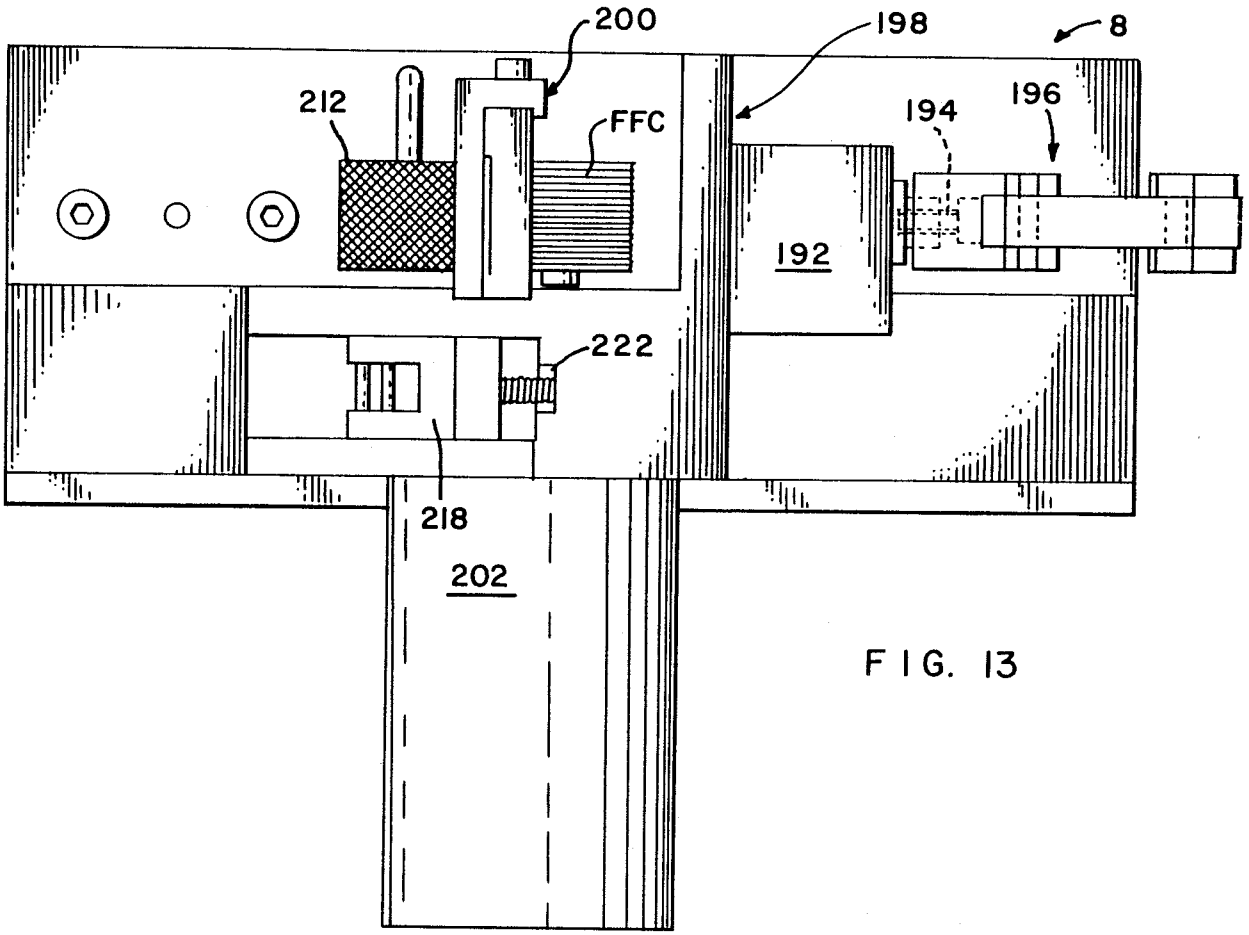
FIG. 13 is a top plan view of the termination station.

As shown in FIGS. 12 and 13, the cable severing blade 60 which is mounted above the push plates 52 and 58, and which is slidable along a cross plate 188 mounted between side plates 190 of the subframe 164, is arranged to be driven towards and away from the anvil 62 by means of a piston and cylinder drive unit 192 having a piston rod 194 connected to the blade 60 by means of a linkage 196. The unit 192 is secured to a subframe 198 on the plate 188 from which extends centrally of the subframe 198, a vertical cable guide 200 aligned with the channel 166, for guiding the cable FFC between the blade 60 and anvil 62 and between the push plates 52 and 58. There projects laterally from the subframe 198, a cable feed stepping motor 202 (FIGS. 4 and 13), the spindle of which is connected to the shaft 204 (FIG. 12) of a driving gear wheel 206 which drives a further gear wheel 208 meshing with a gear wheel 210 fixed to a cable drive roll 212 having a shaft 214 and projecting through a slot 216 in the guide 200 to engage one side of the cable FFC extending therethrough. The shaft 214 of the roll 212 is mounted for rotation in one end of a bifurcated pusher lever 218, the other end of which is pivotally mounted to the subframe 198. Opposite to the roll 212 in the subframe 198, is mounted an idle roll 220, also projecting into the slot 216 to engage the other side of the cable FFC. The roll 212 is urged against the cable FFC in driving relationship therewith, by the spring 222 which urges the lever 218 in a clockwise (as seen in FIG. 12) sense, whereby the cable FFC is driven downwardly each time the motor 204 is run.

There are provided, sensors 224 (FIGS. 7 and 8) for monitoring the horizontal position of the slide 75, sensors 226 (FIGS. 9 and 10) for monitoring the vertical position of the connector holder 30, sensors 228 for monitoring the horizontal positions of the push rods 32, and sensors 230 for monitoring the horizontal positions of the push plates 52 and 58. These sensors as well as the sensor 70 and other sensors (not shown) for monitoring the positions of the other moving parts of the apparatus, serve for signalling the state of the parts concerned to the microprocessor which may be arranged to inhibit further operation of the apparatus in the event of any malfunction thereof.

I claim:

1. Apparatus for connecting to the conductors of a flat, multiconductor cable, electrical connectors having electrical terminals provided with cable conductor receiving portions, the apparatus comprising a press for applying said connectors to the cable by inserting the cable conductors into said conductor receiving portions, means for feeding the cable intermittently through the press, and connector orienting means for supplying the connectors to the press in a plurality of different orientations, said orienting means including a first connector receiving member which is rotatable to determine a first orientation of each connector, first means for transferring each connector from said first connector receiving member, when the connector has been oriented thereby, to a second connector receiving member which is rotatable to determine a second orientation of the connector, and second means for transferring the connector from the second connector receiving member, when the connector has been oriented thereby, to the press.

2. Apparatus according to claim 1 wherein the first connector receiving member is in the form of a pair of jaws rotatably mounted to a frame of the apparatus and being rotatable by drive means on said frame; and the second connector receiving member is in the form of a turntable also mounted for rotation to the frame and having drive means on the frame, said jaws, being arranged for orienting the connectors endwise, and said turntable serving to orient said connectors so that some project from one side of the cable and some from the other when the connectors have been applied to the cable by the press.

3. Apparatus according to claim 2, wherein the first connector-receiving member is translatable transversely of a plurality of rows of different electrical connectors fed in parallel relationship towards the first connector receiving member, to select a connector from any of said rows for application to the cable.

4. Apparatus according to claim 1, for use with connectors each of which comprises a connector body arranged to mate with a cover having conductor stuffing means for forcing the conductors of the cable into the wire receiving portions of the terminals, wherein the connector bodies are supplied to the first connector receiving member with the covers partially mated therewith, a cover separating station being provided between the two connector-receiving members for separating the covers from the connector bodies, the second connector-receiving member having a pair of parallel recesses each adapted to receive either a connector body or a cover, as determined by the angular position of the second connector-receiving member, the press comprising a pair of connector applying members one disposed on each side of the cable, or a connector cover, as determined by said angular position of the second connector receiving member.

5. Apparatus according to claim 4, wherein the cover separating station comprises a connector holder mounted for reciprocating axial movement and having a first nest, for receiving an electrical connector transferred from said first connector-receiving member by a first transfer member of said first transfer means, in a first axial position of the connector holder, the cover from a connector in said first nest and for moving the cover into a second nest spaced from the connector holder at right angles to its direction of movement, said recesses in said second connector-receiving member each being aligned with a respective one of said first and second nests in a given angular position of said second connector-receiving member for the transfer of the connector body and the connector cover by second transfer members of said first transfer means from their respective nests into respective ones of the recesses of the second connector-receiving member.

6. Apparatus according to claim 5, wherein said first transfer member is in the form of a push rod having a drive unit for advancing it to drive a connector in the first connector-receiving means into said first nest, in said first axial position of the connector holder, said second transfer means comprising a first pair of push rods having drive means for advancing them to drive a connector body in said first nest and a connector cover in said second nest, each into a respective recess of the second connector-receiving member, said second transferring means comprising a second pair of push rods having drive means for advancing them to drive a connector body in one recess of the second connector-receiving member and a connector cover in the other recess thereof each into a respective nest of a respective one of said applicator members.

7. Apparatus according to claim 6, wherein said cover separating means comprises a pair of ejector fingers arranged to straddle said connector holder in the second axial position thereof and having a drive unit for advancing said fingers to separate the cover or from the connector in said first nest in said second axial position of the connector holder and the drive said cover against a spring-loaded arm projecting into said second nest to retract the arm outwardly of that nest so as to align the cover in the second nest with the respective second transfer member.

8. Apparatus according to claim 4, wherein the connector-applying members of the press are provided with discrete drive means for selectively driving one of said applying members towards the cable before the other such member.

9. Apparatus according to claim 4, wherein the first connector-receiving member is mounted to a slide for driving the first connector-receiving member towards and away from parallel rows of first and second connectors each mounted on a first length of adhesive tape, said slide being connected to a rotary air cylinder for rotating the piston and cylinder drive unit to rotate the first connector-receiving member about the axis of said piston rod, the rotary air cylinder being connector to drive means for translating it into alignment with a selected one of said rows of connectors, means being provided for advancing each length of tape towards the first connector-receiving member in an advanced position of the slide to locate a connector of the respective row in the first connector-receiving member.

10. Apparatus according to claim 1 wherein said cable feeding means comprises a stepping motor drivingly coupled to a cable drive roll by way of a rear train mounted on a spring-loaded arm urging said drive roll against the cable, frictionally to engage it between said drive roll and an idle roll on the other side of the cable.

* * * * *